US010995952B2

(12) United States Patent
Gray

(10) Patent No.: US 10,995,952 B2
(45) Date of Patent: May 4, 2021

(54) MOBILE YARD WASTE INCINERATOR SYSTEM

(71) Applicant: Marvin L Gray, Tacoma, WA (US)

(72) Inventor: Marvin L Gray, Tacoma, WA (US)

( * ) Notice: Subject to any disclaimer, the term of this patent is extended or adjusted under 35 U.S.C. 154(b) by 78 days.

(21) Appl. No.: 16/376,677

(22) Filed: Apr. 5, 2019

(65) Prior Publication Data

US 2019/0309946 A1 Oct. 10, 2019

Related U.S. Application Data

(60) Provisional application No. 62/653,003, filed on Apr. 5, 2018.

(51) Int. Cl.
*F23G 5/40* (2006.01)
*F23G 7/10* (2006.01)

(52) U.S. Cl.
CPC ..... *F23G 5/40* (2013.01); *F23G 7/10* (2013.01)

(58) Field of Classification Search
CPC ..... F23G 5/40; F23G 5/42; F23G 2203/60; F23G 2203/601; F23G 5/12; F23G 2204/103; F23G 7/02; F23G 7/10; F23G 7/105; F23G 2209/26; F23G 2209/261; F23G 2209/262
See application file for complete search history.

(56) References Cited

U.S. PATENT DOCUMENTS 2,772,438 A * 12/1956 Diaz ..... E01H 1/0827 406/115
3,557,723 A * 1/1971 Miller ..... F23G 7/10 110/254
3,626,876 A * 12/1971 Gardner ..... F23G 7/10 110/349
3,667,407 A * 6/1972 Miller ..... F23G 7/10 110/252
3,785,302 A * 1/1974 Davis ..... F23G 5/40 110/215
4,337,711 A * 7/1982 Bolton ..... F23G 7/105 110/102
6,363,868 B1 * 4/2002 Boswell ..... F23C 3/006 110/213
2010/0293741 A1 * 11/2010 Ferris ..... F23G 1/00 15/339

* cited by examiner

*Primary Examiner* — David J Laux
(74) *Attorney, Agent, or Firm* — Dean A. Craine, P.S.

(57) ABSTRACT

A portable, yard waste incinerator system with a large burn tank located on a transport and configured for burning yard waste. Located inside the burn tank is lower primary combustion chamber and an upper secondary chamber, Located inside the primary burn housing with a burner. Propane fuel is connected to an external propane gas source which delivers propane to the burner. The primary burn housing includes a plurality of holes that allows flames and hot gases from the fire and heat from the primary combustion chamber to extend into a secondary combustion chamber. The system also includes a vacuum system which picks up small, loose combustible debris from the yard and delivers the debris and oxygen to the secondary combustion chamber. The system also includes an optional electric generator that energizes the vacuum system and an optional shredder that delivers shredded yard waste to the secondary burning chamber.

6 Claims, 6 Drawing Sheets

MOBILE YARD WASTE INCINERATOR SYSTEM

This utility patent application is based on and claims the filing date benefit of U.S. Provisional Patent Application (Application No. 62/653,003) filed on Apr. 5, 2018.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to yard waste collectors, and more particularly to yard waste collectors that incinerate the collected yard waste onsite.

DESCRIPTION OF THE RELATED ART

Residential landscape workers prefer to work in neighborhoods, so they can sequentially work in several yards in the neighborhood. The workers not only cut lawns and prune plants, but they also pickup dead branches, pick weeds, rake flower beds and haul the collected yard waste away. If the landowner has dogs and cats, the worker is also expected to pick up animal waste from the yard and dispose of it properly.

Collecting leaves, twigs, and branches from a yard and burning them in a burn barrel is well known. Lawn clippings are normally not burned because they are usually wet. In order to burn lawn clippings, the fire must be hot and well ventilated. Unfortunately, the lawn clippings collapse into a pile and eventually smother the fire. In order to maintain combustion, an outside fuel source and a constant volume of oxygen must be delivered.

What is needed is a portable yard waste incinerator that can be quickly and easily used to burn relatively large volumes of yard waste collected from the yard.

SUMMARY OF THE INVENTION

This object is met by a mobile yard waste incinerator system disclosed that includes a burn tank with a primary combustion chamber and a surrounding secondary combustion chamber. The primary combustion chamber is partially isolated from the secondary combustion chamber so yard waste material deposited into the burn tank does not directly fill the primary combustion chamber. The primary combustion chamber is located inside a primary burner housing that includes a top plate and vertically aligned side walls. Located inside the primary burner housing is a gas burner. The gas burner is coupled to an external propane tank. Connected to the primary burner housing is an outside air delivery system that allows outside atmospheric air to flow into the primary combustion chamber.

Formed on the top plate and side walls of the primary burner housing are optional small hot air/flame vents that allow hot gases to flow from the primary combustion chamber into the secondary combustion chamber.

Blending upward from the primary burning housing is a flue pipe. The end of flue pipe extends outside the burn tank and transports smoke and combustion gases from the primary burning housing to the atmosphere. An optional grate may be installed in die flue pipe to capture sparks and airborne ash particles.

Yard waste is deposited into the secondary combustion chamber via a vacuum exhaust port or through a large waste opening formed on the sides of the burn tank. When yard, waste is deposited in the secondary combustion chamber, it comes in contact with the top plate and side walls of the primary burner housing. Heat from the top plate and the side walls and hot gases from the vents formed thereon heat and combust the yard waste. Because the primary combustion chamber is isolated from the secondary combustion chamber, yard waste does not fill the primary combustion chamber and combustion inside the primary combustion chamber is not disturbed.

In one embodiment, the flue pipe extends through a flue opening formed on the burn tank. The flue opening extends inward and communicates with the secondary combustion hot gases to escape from the secondary combustion chamber.

The system also includes a vacuum system with an exhaust air pipe that connects to the burn tank. The vacuum system creates a vacuum configured to pick up small, loose combustible yard waste from the yard using a long vacuum tube. The long vacuum tube picks up yard waste and delivers it to a tank. The yard waste then travels from the tank via an exhaust air pipe to the exhaust air port formed on the burn tank. The yard waste is then deposited into the secondary combustion chamber.

The system may also include a propane gas tank and an electric generator used to energize the vacuum system.

The system may also include an optional wood or yard waste shredder that also connects to the burn tank.

The burn tank may also include an animal waste shoot that allows workers to deposit animal waste into the burning waste for incineration.

The entire system describe above is mounted on a transport vehicle, such as a flatbed truck or trailer so the system may be transported to the landscaping yard site and used to incinerate yard waste onsite.

DESCRIPTION OF IRE DRAWINGS

DESCRIPTION OF THE PREFERRED EMBODIMENT(S)

Figure 1:
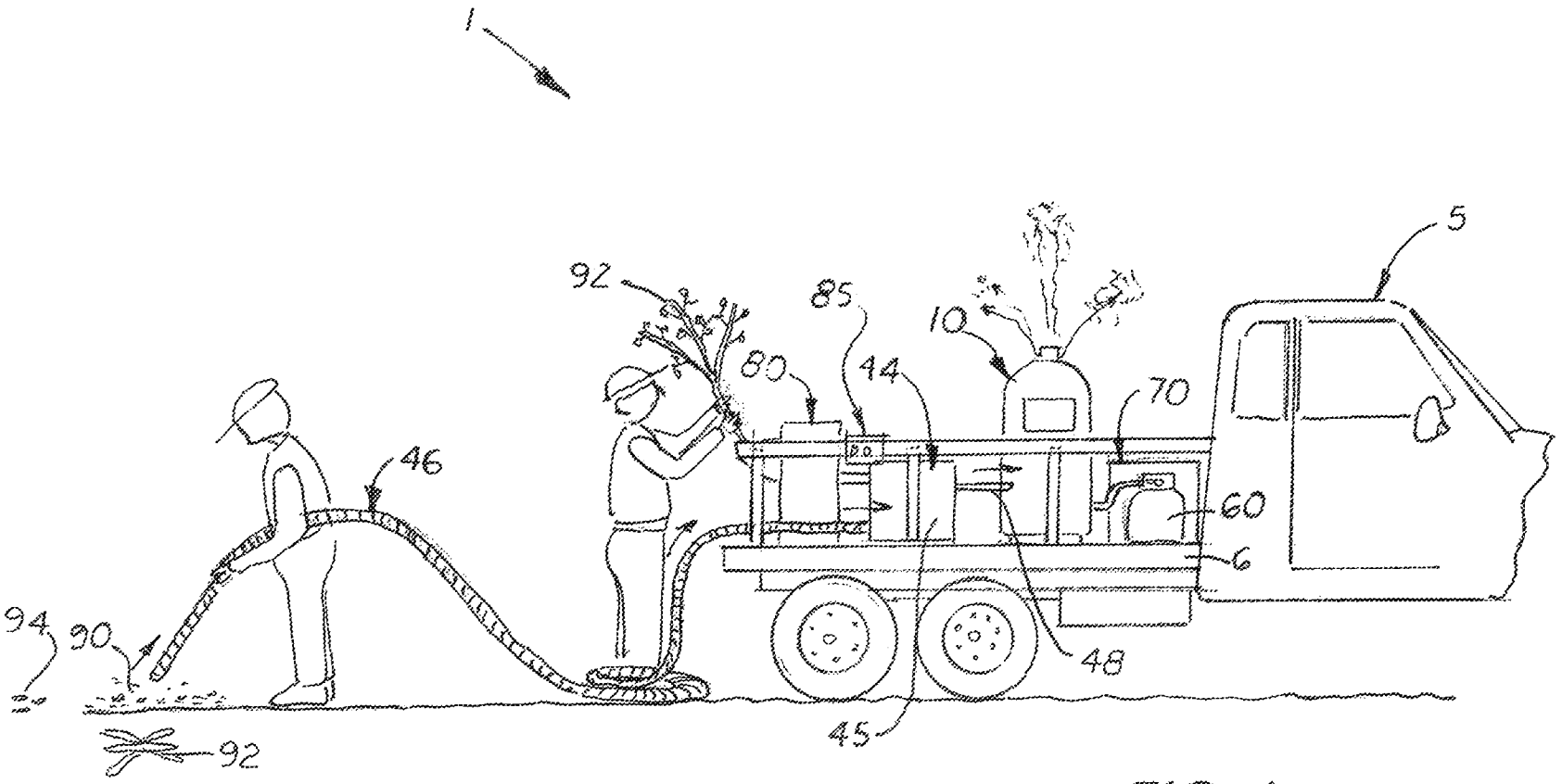
FIG. 1 is an illustration showing the mobile yard waste incinerator system mounted on the bed of a pickup truck.
Figure 2:
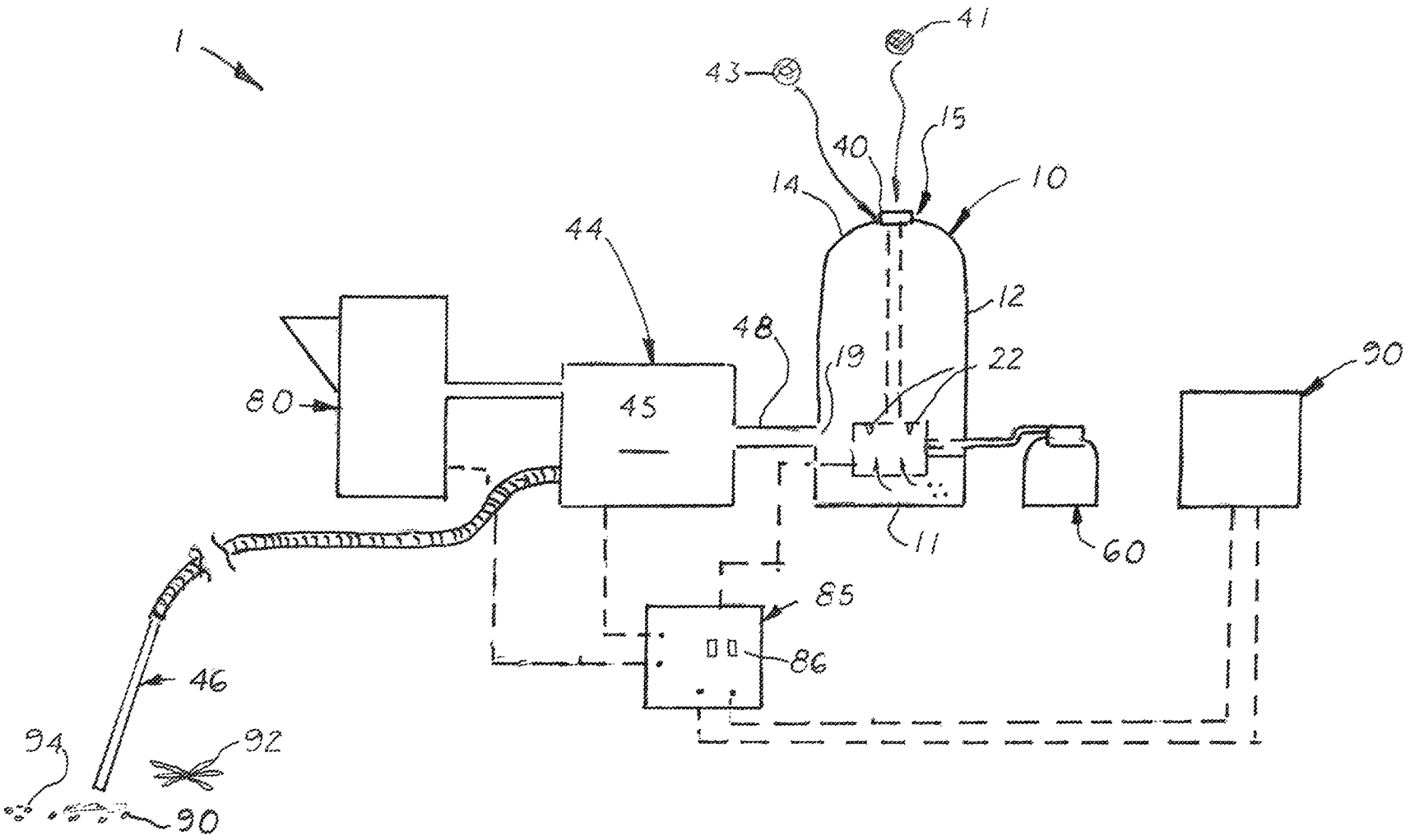
FIG. 2 is a diagram of the mobile yard waste incinerator system shown in FIG. 1.
Figure 4:
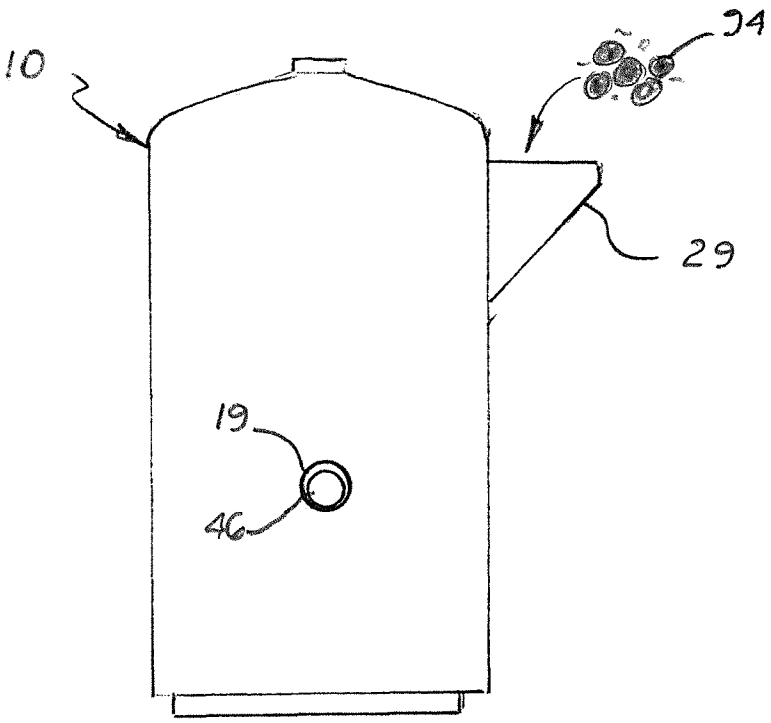
FIG. 4 is a left side elevational view of the burn tank.

A mobile yard waste incinerator system 1 is disclosed that includes a truck or similar vehicle 5 with a burn tank 10, a vacuum system 44, a propane tank 60, an electrical generator 70, and an optional shredder 80. In the embodiment shown in FIG. 1, all the components are shown mounted on the bed 6 of a transport vehicle 5 (i.e. truck). The system 1 is used to burn combustible yard waste 90, such as grass clippings, fallen leaves, twigs, needles, pine cones, small scraps of paper and cigarette butts that have fallen to the ground, branches 92 and animal waste 94.

The system 1 includes an insulated burn tank 10 containing a small primary combustion chamber 21 and a large secondary combustion chamber 32 located, around the primary combustion chamber 21, The burn tank 10 includes a closed bottom end 11, side walls 12, and an upper end 14. Formed on the upper end 14 is a flue opening 15.

Figure 5:
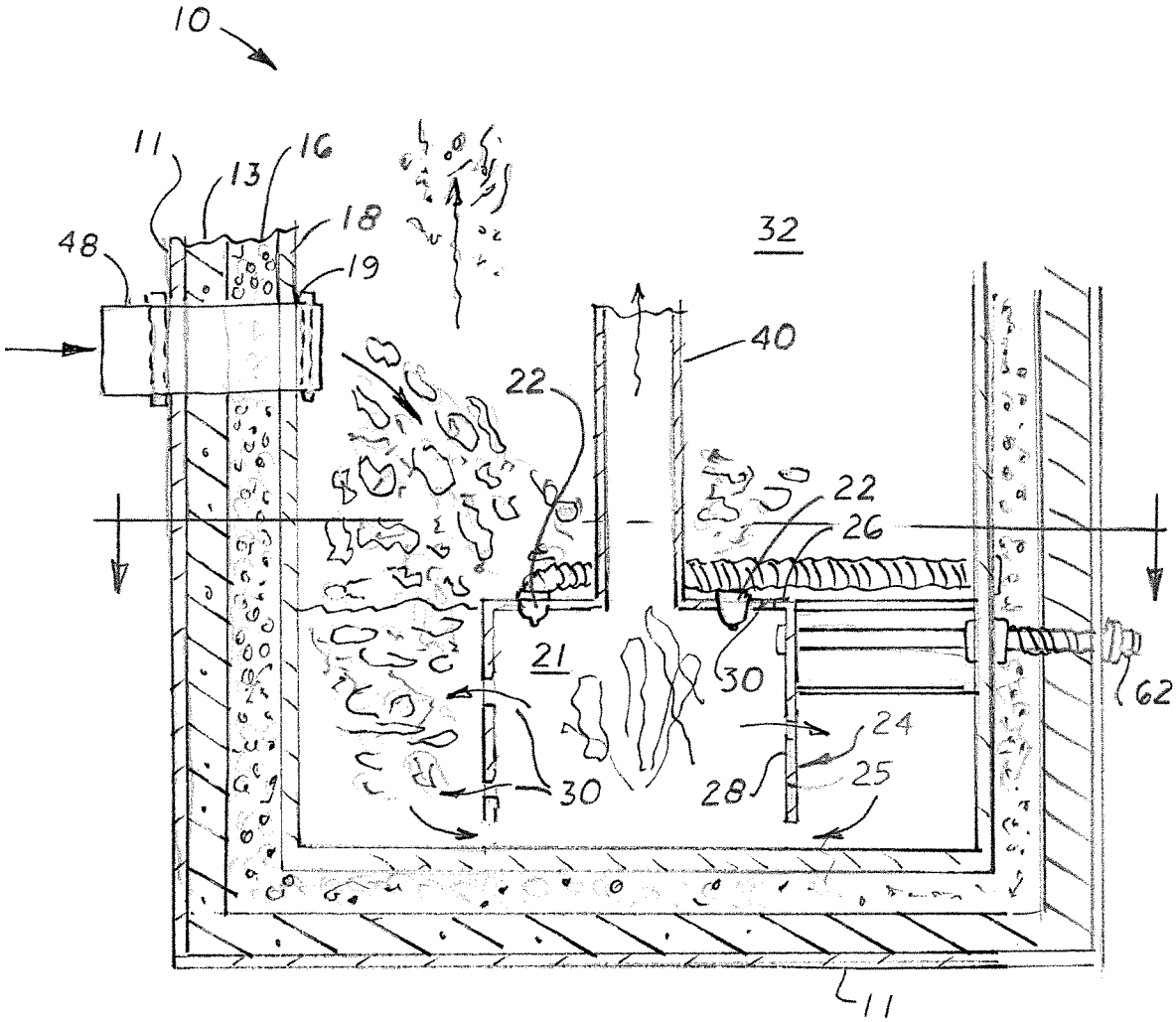
FIG. 5 is a partial, exploded sectional view of the burn tank.

Located inside the burn tank 10 is a primary burner housing 24 containing at least one burner 22 (two burners 22 shown in FIG. 5). In the embodiment shown in the Figs, the primary burner housing 24 is cylindrical with a horizontal top plate 26 and vertically aligned side walls 28. The primary burner housing 24 may be mounted directly on the bottom end 11 of the burn tank 10 or mounted on a transversely aligned lower platform 17 (shown in FIG. 5).

The primary burner housing 24 is hollow forming the primary combustion chamber 21 therein. Formed on the bottom edge of primary burner housing 24 is one or more ventilation holes 25 that allow outside atmospheric air to enter the primary, combustion chamber 21. During operation, outside atmospheric air can travel into the lower section of the burn tank 10 and through the ventilation holes 25 and into the primary combustion chamber 21. In another embodiment, a separate air conduit may be provided that extends from the side walls 12 of the burn tank 10 to the primary burner housing 24.

Formed on the top plate 26 and side walls 28 on the primary burner housing 24 are small exhaust holes 30 that allow hot gas and flames from a fire created inside the primary combustion chamber 21 to extend through.

The primary burner housing 24 is coaxially aligned inside the burn tank 10. It is also smaller in diameter than the burn tank 10 thereby forming a lower area of the secondary combustion chamber 32 between the inside wall of the burn tank 10 and the side walls 28 of the primary burner housing 24. The primary burner housing 24 is also shorter than the burner tank 10 creating a large upper area of the secondary combustion chamber 32 above the primary burner housing 24. During use, yard waste 90, branches 92 and animal waste 94 is deposited inside the lower area of the secondary combustion chamber 32. As more yard waste 90, branches 92 and animal waste 94 is deposited into the burn tank 10, the upper area of the secondary combustion chamber 32 is gradually filled. The amount of waste material added to the burn tank 10 depends on the type of yard waste and its wetness. The rate of deposit is also controlled so that the burn tank 10 is not overfilled.

When yard waste 90, branches 92 or animal waste 94 are deposited in the secondary combustion chamber 32, it encounters the top plate 26 and side walls 28 on the primary burner housing 24 and the hot gases and flames pass through the holes 30 formed on the top plate 26 and side walls 28.

The primary burner housing 24 is connected to a flue pipe 40 that extends upward and extends through a flue opening 15 formed on the upper end 14 of the burn tank 10. Formed inside the flue pipe 40 is a flue screen 41 configured to capture sparks and flying material that travels up the flue pipe 40. The flue opening 15 that is larger than the flue pipe 44 and thereby creates a secondary flue opening 42 for gas, heat and small particles created in the secondary combustion chamber 32 to escape from the burn tank 10. Disposed around the flue pipe 40 and extending transversely over the secondary flue opening 42 is an optional secondary screen 43 used to capture sparks and flying material from the secondary combustion chamber 32. The mesh opening on the primary and secondary screens 41, 43 are sufficiently small to capture particles larger than ½ from escaping from the burn tank 10.

Figure 3:
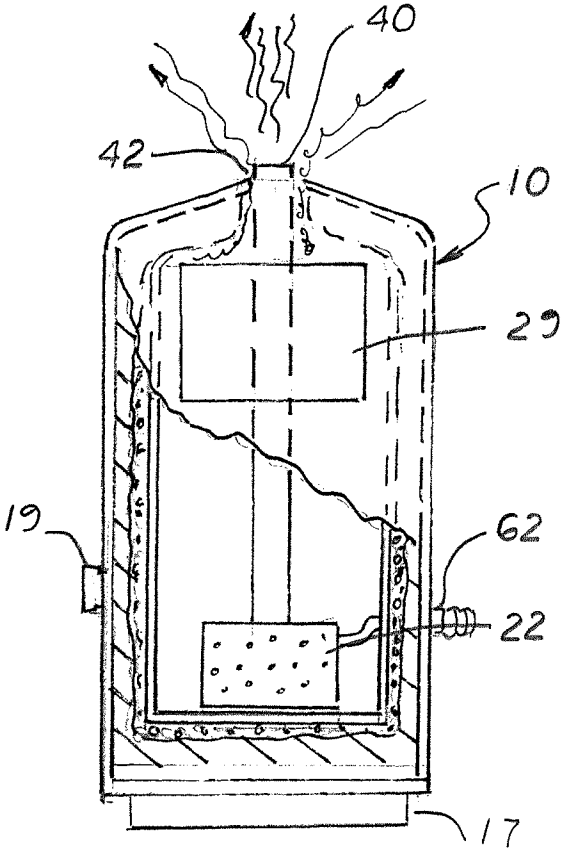
FIG. 3 is a sectional, front elevational view of the burn tank.
Figure 6:
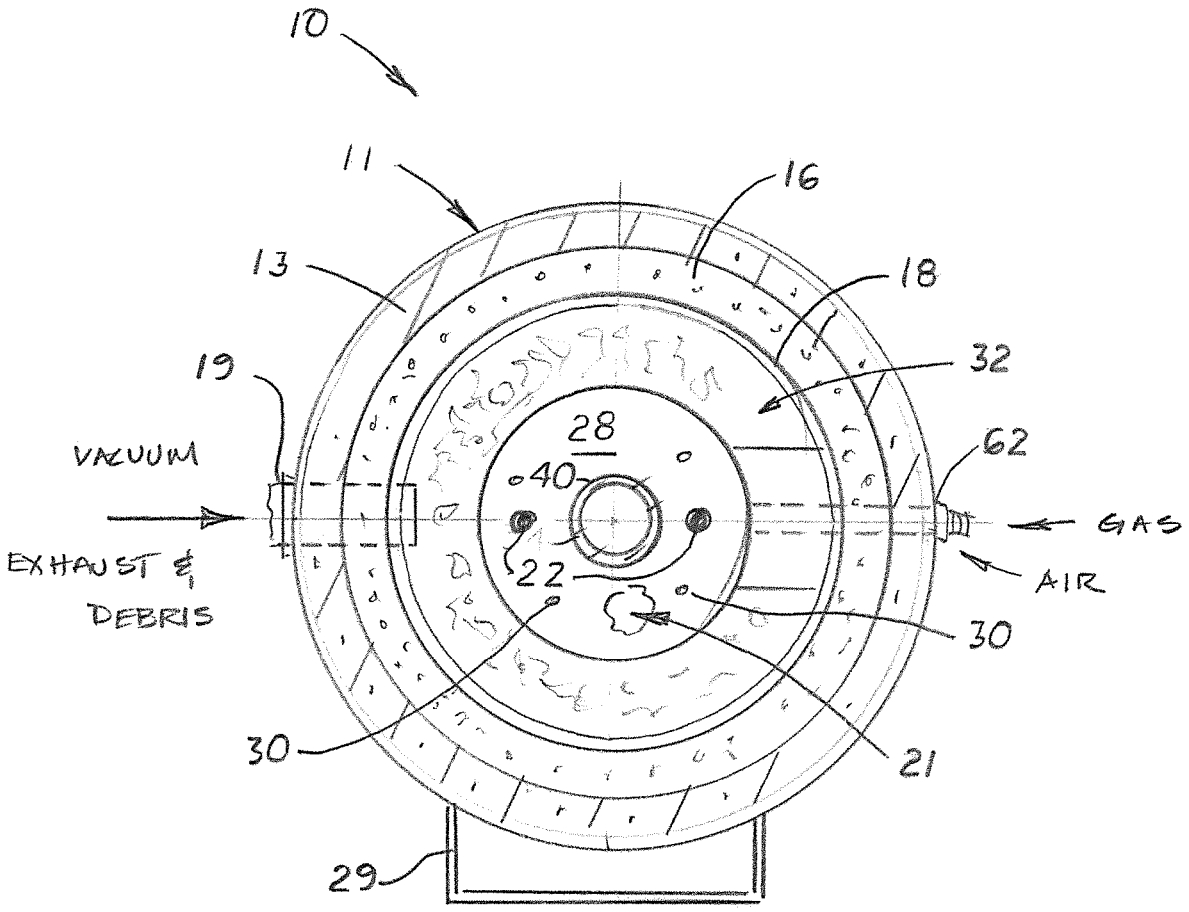
FIG. 6 is a partial top plan view of the burn tank.

As shown in FIGS. 3 and 6, the burn tank 10 includes an outer layer 11 made of steel. Formed along the inside surface of the outer layer 11 is an insulation layer 13. Formed along the inside surface of the insulation layer 13 is a cement layer 16. Located inside the cement layer 16 is an optional inner lining 18 made of steel. Located inside the inner lining 18 is the secondary combustion chamber 32 described above. The cement layer 16 is approximately ¾ to 2 inches think.

The system 1 also includes a vacuum system 44 with a vacuum exhaust pipe 48 that connects to an exhaust inlet port 19 formed on the burn tank 10. As shown in FIG. 1, the vacuum system 44 includes a long, lightweight vacuum tube 46 that is manually moved over the yard to pick up yard waste 90, such as grass clippings, branches 92 or animal waste 94, and delivers it to a tank 45. The vacuum system 44 includes an exhaust tube 48 that extends from the tank 45 and connects to an exhaust inlet port 19 formed on the side walls of the burn tank 10 which not only delivers the yard waste 90 and branches 92 to the burn tank 20 but also delivers additional outside air to the burn tank 10 to support combustion in the secondary combustion chambers 32.

The system 1 also includes a portable gas or diesel fuel electric generator 70 used to electrically energize the vacuum system 44. The system 1 also includes a propane tank 60 that connects to a gas supply line 62 that extends into the burn tank 10 and provides propane gas to the primary burner 22.

The system 1 may also include an option wood or yard waste shredder 80 that also connects to the burner tank 10.

Also, formed on the side of the burn tank 10 is an optional large waste opening 29. In the preferred embodiment, the opening 29 is covered by an optional door that allows the opening to be selectively opened and closed by workers to deposit animal waste 94 into the secondary combustion chamber 32 inside the burn tank 10.

Figure 7:
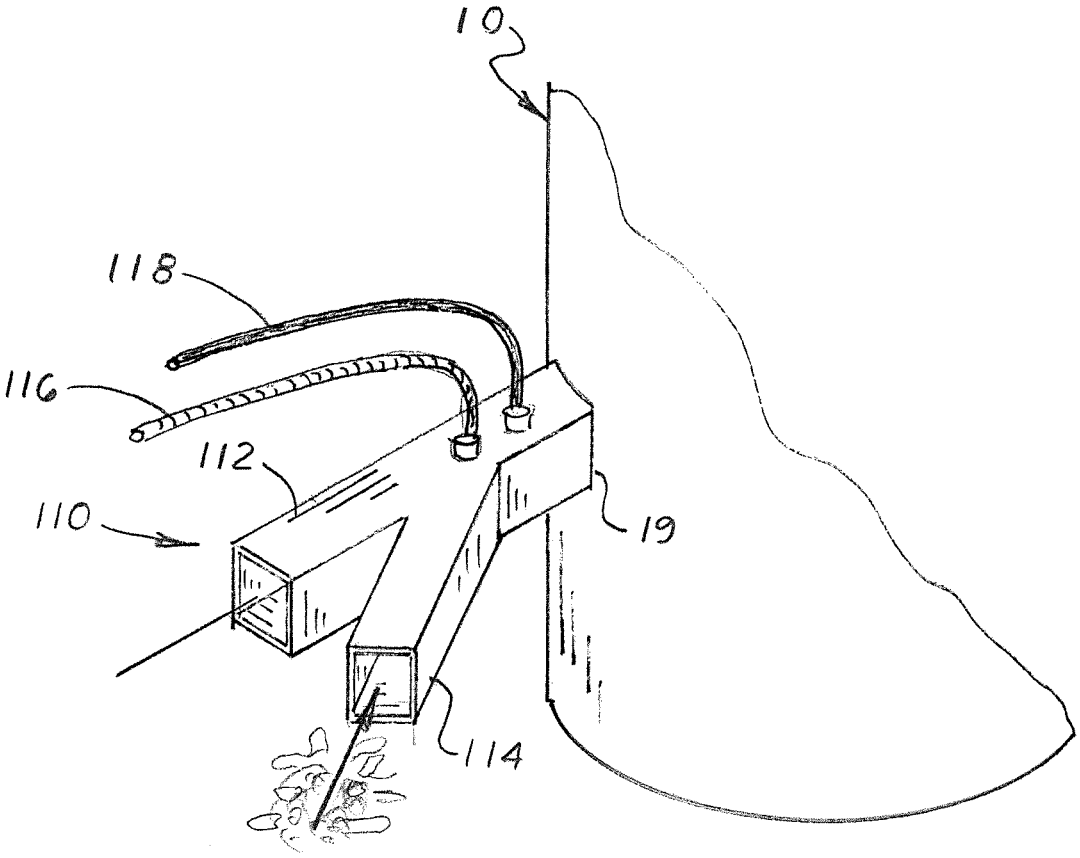
FIG. 7 is a partial perspective view of the burn tank with an optional fork connector attached to the input port on the burn tank that connects to the vacuum system and to the shredder.

FIG. 7 is a partial perspective view of the burn tank 10 with an optional fork connector 110 attached to the exhaust inlet port 19 on the burn tank 20, The connector 110 includes a first leg 112 that connects to a vacuum system 44 and a second leg 114 that attaches to the shredder 80.

The vacuum system 44, the generator 55 and the shredder 80 may be connected to a main control panel 85 with switches 86 that enable workers to easily activate and deactivate these components.

The entire system 1 is mounted on a truck, trailer or similar transport vehicle 5 enabling the system 1 to be easily transported to different yards and used to incinerate yard waste from the yards. In the embodiment shown in the Figs, the burn tank 10 is cylindrical shaped and measures approximately 36 to 50 inches in length and 20 to 30 inches in diameter. It should be understood that the burn tank 10 may have a different configurations and sizes. As shown in nu. 1, the burn tank 10 may be mounted directly on the bed or mounted on an elevated support stand 17. The gas conduit inlet port 62 is approximately ¾ inches in diameter and located 6 to 12 inches from the bottom edge of the burn tank 10. The vacuum exhaust inlet port 19 is located above near the midline axis of the burn tank 10. Located above the vacuum inlet port 19 is a large debris dumping opening 29.

The primary burner housing 22 is approximately 8 to 24 inches in diameter and 8 to 16 inches in height. The holes on the top plate 26 and the side walls 28 are approximately 118 to ½ inches in dimeter and 1 to 6 inches apart. The flue pipe 40 is approximately 3 inches in diameter and 24 to 48 inches in length.

During use, propane fuel is delivered to the primary burner 22 and ignited. Yard waste 90 is then delivered to the secondary combustion chamber 32 via either the vacuum exhaust inlet port 19 or via the large debris opening 29. When yard waste 90 is deposited inside the secondary combustion chamber 32, it does not directly fall into the primary combustion chamber 22 and smother the flame located inside the primary combustion chamber 22. Propane fuel and oxygen is continuously delivered to the primary combustion chamber 22.

The operator monitors combustion inside the burn tank 10 and controls the temperature inside the primary combustion chamber 22 by controlling the amount of propane gas delivered to the primary combustion chamber 22. When the vacuum system 44 is activated, additional oxygen is delivered to the secondary combustion chamber 32 to support additional combustion of the yard waste inside the secondary combustion chamber 32.

In most instances, nearly all of the yard waste 90, 92, and 94 is combusted forming very little ash inside the burn tank 10. Any remaining ash can be expelled from the burn tank 10 by forcing air into the burn tank via the vacuum exhaust tube 48.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A mobile yard waste incinerator system, comprising;

a. a transport vehicle;

b. a burn tank located on the transport vehicle configured for burning yard waste, the burn tank includes a primary combustion chamber with a primary burner housing located therein, the primary burn housing is smaller than the burn tank thereby forming a secondary combustion chamber above the primary burn housing, the burn tank includes a flue opening;

c. at least one burner located inside the primary combustion chamber;

d. propane fuel tank located outside the burn tank and connected to the burner located inside the primary burner housing;

e. a flue pipe that extends from the primary burner housing to the flue opening formed on the burn tank;

f. a vacuum system includes a vacuum tank and a vacuum tube connected to the vacuum tank, the vacuum system being configured to pick up small, loose combustible debris from a yard, the vacuum system also includes an exhaust tube connected to the tank that delivers air and debris to the secondary combustion chamber;

g. an electric generator and connected to the vacuum system.

2. The mobile yard waste incinerator system, as recited in claim 1, further including a shredder connected to the burn tank.

3. The mobile yard waste incinerator system, as recited in claim 1, wherein the burn tank includes a waste opening.

4. The mobile yard waste incinerator system, as recited in claim 1, where the burn tank includes a steel outer layer, an insulation layer, a cement layer, and an inner lining.

5. The mobile yard waste incinerator system, as recited in claim 1, farther including an air inlet configured to deliver atmospheric air to the primary combustion chamber.

6. The mobile yard waste incinerator system, as recited in claim 1, wherein the primary burner housing is coaxially aligned inside the burn tank.

* * * * *